US006128842A

United States Patent [19]

Lotspeich et al.

[11] Patent Number: 6,128,842

[45] **Date of Patent: *Oct. 10, 2000**

[54] ADVERTISING DISPLAY PANEL

[75] Inventors: Joseph Allen Lotspeich, West St. Paul, Minn.; Robert Lee McMullen, Hudson, Wis.

[73] Assignee: Gross-Given Manufacturing Company, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,571

[22] Filed: Oct. 31, 1996

[51] Int. Cl.[7] ..... G09F 7/02

[52] U.S. Cl. ..... 40/611; 40/661.06; 312/234.5

[58] Field of Search ..... 40/575, 611, 308, 40/642.02, 661.06; 312/138.1, 234, 234.3, 265.6, 326, 204, 292, 234.5, 234.4, 321.5

[56] References Cited

U.S. PATENT DOCUMENTS

| | | | |
|---|---|---|---|
| 3,793,756 | 2/1974 | Kay et al. | 40/611 X |
| 3,934,367 | 1/1976 | Philipp | 40/705 |
| 4,001,957 | 1/1977 | de Lima Castro | 40/661 |
| 4,320,933 | 3/1982 | Felix et al. | 312/265.6 X |
| 4,765,074 | 8/1988 | Loos | 40/308 X |
| 4,809,454 | 3/1989 | Weisman | 40/611 |
| 5,235,767 | 8/1993 | Waterman et al. | 40/308 |
| 5,255,968 | 10/1993 | Craven | 40/575 X |
| 5,372,416 | 12/1994 | Shapley et al. | 312/138.1 |
| 5,392,548 | 2/1995 | Truc et al. | 40/705 |
| 5,488,656 | 1/1996 | DeArkland | 40/611 X |
| 5,509,225 | 4/1996 | Minh et al. | 40/611 |

*Primary Examiner*—Brian K. Green
*Attorney, Agent, or Firm*—Merchant & Gould P.C.

[57] ABSTRACT

A display is releasably mounted on the outside of an enclosure. The display may be released from the enclosure upon gaining access to the inside of the latter. In a preferred embodiment, the display is a sign, and the enclosure is a vending machine. The sign includes a rear panel, which is secured to the door of the vending machine, and a front panel which is connected to the rear panel by means of a hinge. A fastener on the front panel, disposed generally opposite the hinge, protrudes through a hole in the rear panel and into an opening in the vending machine door. The relative sizes of the fastener and the hole are such that a portion of the fastener snaps into place on the opposite side of the rear panel.

18 Claims, 3 Drawing Sheets

ADVERTISING DISPLAY PANEL

FIELD OF THE INVENTION

This invention generally relates to an advertising display panel, and more particularly to a point of sale advertising display panel for mounting on securable panels such as on the front door panel of a vending machine.

BACKGROUND OF THE INVENTION

Hard copy advertising by means of billboards, display panels and the like remains as one of the most effective widespread means for reaching and influencing purchasers in close time-proximity to their purchasing decisions. Point of sale display panels (i.e., those placed in close proximity to the item being purchased, or at the location where a purchaser makes his or her actual final purchase selection from a plurality of choices), have been found to be particularly effective at conditioning a purchaser to select the product or service advertised on the point of sale display. Point of sale advertising can be particularly effective when strategically placed on a vending machine. A purchaser approaching a vending machine is already committed to purchasing a product held by the machine. The question is which one? Many purchasers do not make their final selection until the last possible moment. For such purchasers, point of sale advertising placed on the machine where the purchaser cannot help but see it, can effectively influence his/her final selection.

Such point of sale displays must be aesthetically unobtrusive so as to fit in with the decor of the item on which they are placed, yet be fairly tamper proof so that their display contents cannot be changed by unauthorized personnel. They should also be easy to operate so that advertising display pieces can be readily changed or replaced when desired without undue complications. Such displays should also preferably be of a construction that is adaptable for use in a large variety of applications, and preferably accommodate easy retrofitting installation to varied equipment or uses and for ready installation on machines which have not been specifically designed to accommodate such displays.

The present invention provides a relatively inexpensive yet reliable point of sale display panel that addresses the above needs and preferences. The display panel of this invention is very simple in construction, aesthetically pleasing and universally adaptable to varied applications, and enables ease of use with a high tamper proof tolerance.

SUMMARY OF THE INVENTION

The present invention provides a display panel and fastening system therefor. In a preferred embodiment, the display is mounted on the door of a vending machine. The preferred embodiment display includes a rear panel, which is appropriately secured to the door by for example adhesive or screws; a front panel, which is secured to the rear panel by means of a hinge; and a window on the front panel, through which one can view a sheet disposed between the front panel and the rear panel. A latch on the front panel engages a catch on the rear panel to releasably lock the former relative to the latter and enclose the sheet in between. The latch can be released only by gaining access to the opposite side of the rear panel, which is accessible only from the inside of the vending machine door. Thus, when the door is locked, the display cannot be opened and the sheet can be removed only by authorized personnel having access to the inside of the vending machine. Many of the advantages of the present invention should become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

The display panel of this invention is particularly adapted for point of sale applications wherein it is desirable to give a purchaser a final suggestion before the purchaser makes his/her actual selection. The display panel is uniquely configured for attachment to and use with a panel member such as a door or the like that can be secured such that the display panel can only be opened and accessed either from or through the back side of the panel. Since one of the most practical applications for the invention is in combination with the front door or panel of a vending machine, for providing point of sale advertising to a purchaser making selections from the vending machine, the preferred embodiment of the invention will be described in association with a vending machine.

Figure 2:
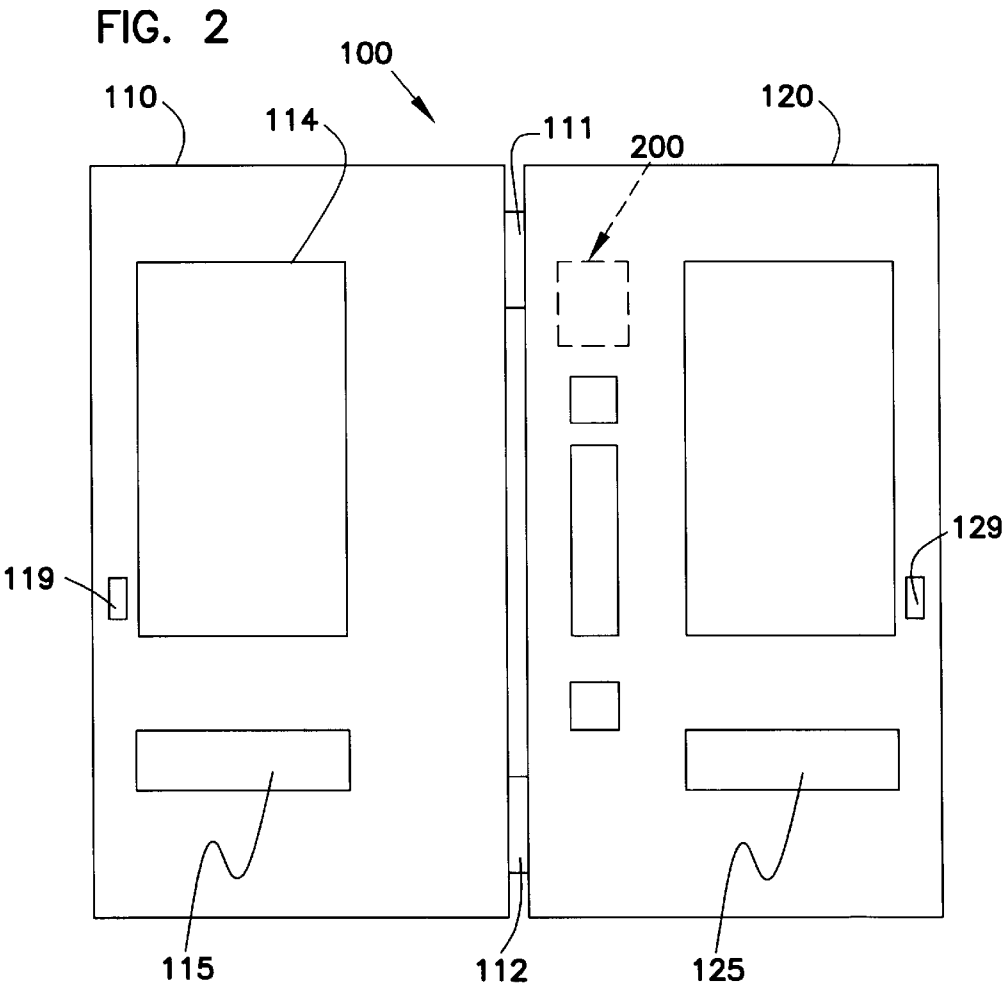
FIG. 2 is a front view of the vending machine of FIG. 1, shown with its door in an open configuration.
Figure 1:
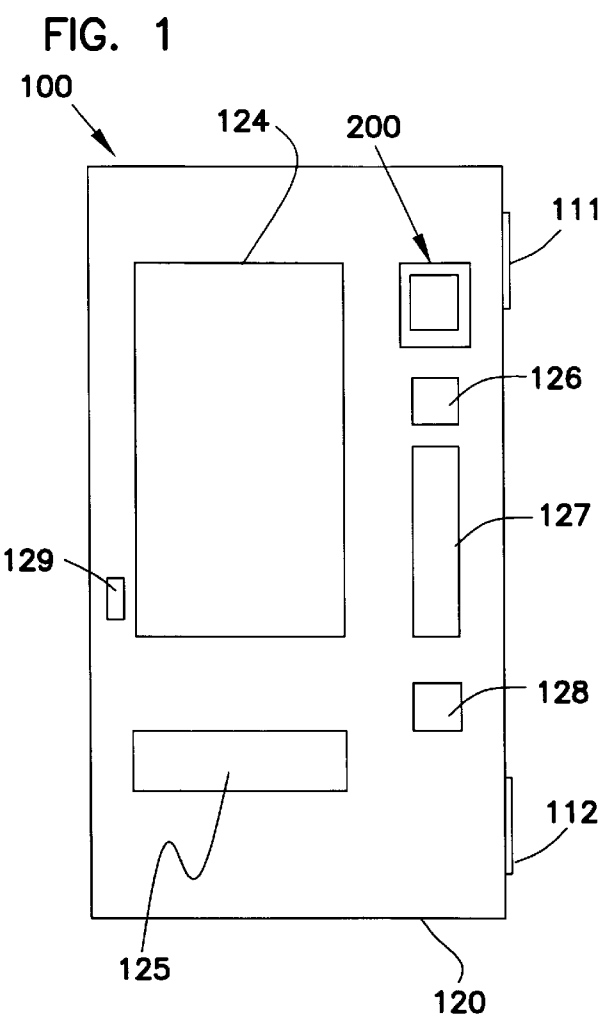
FIG. 1 is a front view of a preferred embodiment vending machine constructed according to the principles of the present invention, shown in a closed configuration.
Figure 3:
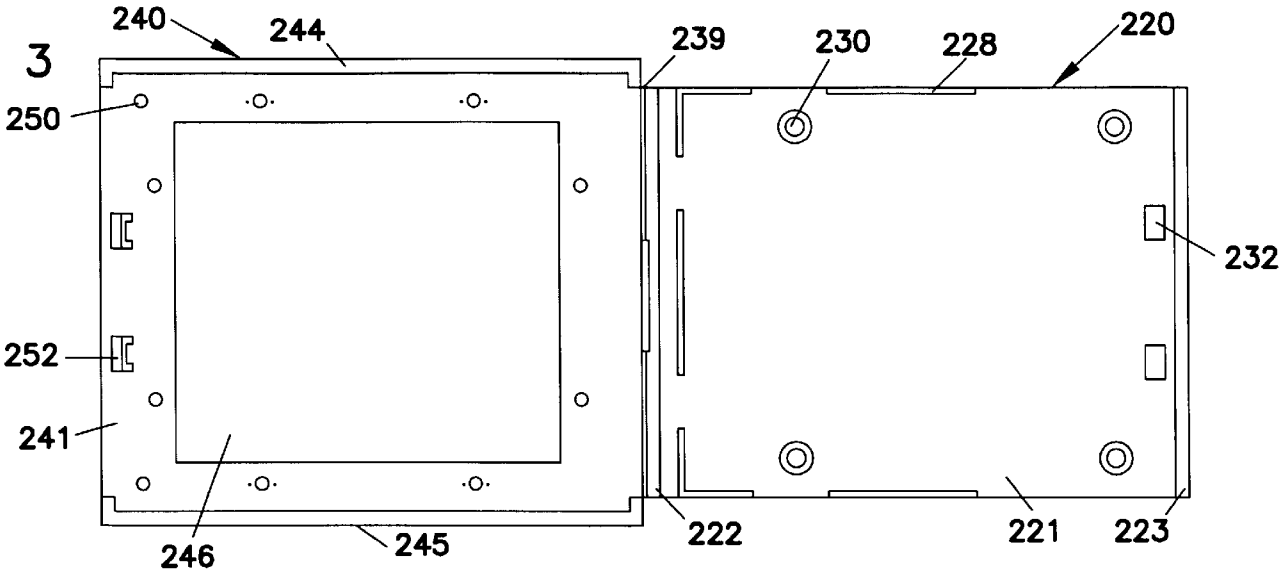
FIG. 3 is a plan view of the display frame on the vending machine of FIG. 1 illustrated in an open configuration.

A preferred embodiment vending machine constructed according to the principles of the present invention is designated as 100 in FIGS. 1–2. The vending machine 100 could be of any type well known in the art, as for example, a snack and/or beverage type of dispenser such as shown in U.S. Pat. No. 4,061,245 or Des. 316,728 or the Model LCM1 or Model 111 vending machines sold by Automatic Products International, Ltd. To the extent that the disclosures or teachings of U.S. Pat. No. 4,061,245 or Des. 316,728 are needed for a more complete understanding of the invention, they are herein incorporated by reference. The vending machine 100 generally includes a base or main compartment 110 and a door 120 which cooperate to define a housing or enclosure. Hinges 111 and 112 interconnect one side of the door 120 to one side of the base 110, thereby allowing the former to pivot relative to the latter. A lock, including interengaging components 119 and 129, selectively interconnects an opposite side of the door 120 to an opposite side of the base 110, thereby selectively preventing the former from pivoting relative to the latter, and discouraging unauthorized access to the inside of the enclosure.

The vending machine 100 may store goods in rows, for example, in the region designated as 114. The goods may be visible through a window 124 on the door 120. A mechanism known in the art functions to deliver individual units of the goods to a tray designated as 115. The tray 115 is accessible through a slot 125 in the door 120. A depository 126 accepts money, and a control panel 127 facilitates selection of a particular good for delivery to the tray 115. To the extent that the deposited money exceeds the price of the good, a mechanism known in the art returns excess change to a receptacle 128.

The vending machine 100 also includes a sign or display 200, the components of which are shown in greater detail in FIGS. 3–6. In the preferred embodiment, the display 200 includes a rear panel 220, a front panel 240, and a window 260, as well as fasteners suitable for mounting the rear panel 220 to the door 120.

The rear panel 220 includes a generally flat and rectangular sheet 221 of polypropylene having in the preferred embodiment a mean thickness of approximately one-tenth of an inch. Linear ridges or embossments 222 and 223 extend along opposite ends of the sheet 221. Relatively smaller ridges 228 extend intermittently along opposite sides and one end of the sheet 221 (inward of the ridge 222 on the end of the sheet 221 that is common to both).

In the preferred embodiment, holes 230 have frustoconical sidewalls and are formed through the rear panel 220 proximate each of the four corners thereof. Each hole 230 is sized and configured to receive the head of a fastener, such as a screw. Also, two rectangular slots 232 are formed through the sheet 221, proximate the ridge 223, for reasons discussed below.

A living hinge 239 connects an end of the front panel 240 to the end of the sheet 221 opposite the slots 232. In other words, the rear panel 220 and the front panel 240 may be said to be integrally molded together and/or pivotally secured relative to one another.

The front panel 240 includes a generally flat and rectangular frame 241 of polypropylene having a mean thickness of approximately one-tenth of an inch. The perimeter of the front panel 240 is similar in size and shape to that of the rear panel 220. Linear ridges or embossments 244 and 245 extend along opposite sides of the frame 241. When the front panel 240 is folded toward the rear panel 220 and into substantially parallel relationship therewith, the two panels 240 and 220 cooperate to form a parallelepiped housing bordered by the sheets 241 and 221, the end walls or ridges 222 and 223, and the side walls or ridges 244 and 245. The front panel 240 borders a rectangular opening 246 in the front face of the parallelepiped housing.

A plurality of posts or stakes 250 are disposed about the perimeter of the frame 241 and protrude rearward therefrom (toward the rear panel 240) for reasons discussed below. Also, two prongs or latches 252 are disposed at the end of the frame 241 opposite the hinge 239 and protrude rearward, as well. Both the prongs 252 and the posts 250 are integrally molded to the frame 241.

Figure 5:
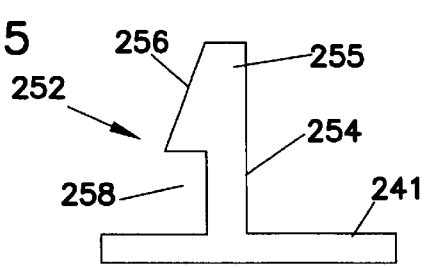
FIG. 5 is a profile of one of the prongs of the display frame of FIG. 3.
Figure 4:
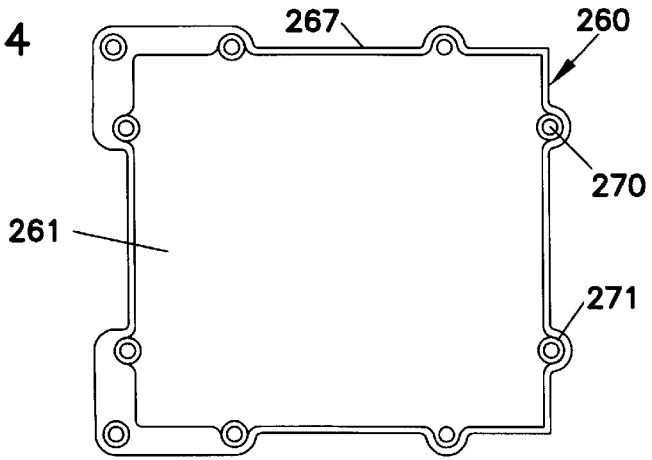
FIG. 4 is a plan view of a frame window for the display frame of FIG. 3.

A profile of one of the prongs 252 is shown in FIG. 5. Each prong 252 includes a relatively narrow stem 254 and a relatively larger head 255. The head 255 cooperates with the frame 241 and the stem 254 to define a notch 258 between the head 255 and the frame 241. An angled surface 256 is disposed on the head 255 and faces in the same general direction as the notch 258.

As the front panel 240 is folded toward the rear panel 220 and into substantially parallel relationship therewith, each of the angled surfaces 256 engages an edge of a respective slot 232, thereby causing a respective stem 254 to yieldingly bend. As either head 255 fully penetrates a respective slot 232, the notch 258 reaches the edge of the slot 232, and the resilience of the stem 254 biases the stem 254 and head 255 back toward their previous, unstressed orientation (extending perpendicular from the frame 241). In this manner, each of the heads 255 locks in place behind the rear panel 220. Each of the prongs 252 may be subsequently unlocked or unlatched simply by gaining access to the rear of the rear panel 220 and pushing the heads 255 back into complete alignment with their respective slots 232 and out same.

The frame window 260 includes a generally flat and rectangular sheet 261 of acrylic having a mean thickness of approximately one-sixteenth of an inch. The perimeter of the frame window 260 is sized and shaped to lie within the parallelepiped housing defined by the ridges 222 and 223 and the ridges 244 and 245, as well as the sheet 221 and the frame 241. A lip 267 extends about the entire perimeter of the sheet 261, thereby enhancing the structural integrity of the frame window 260 and also providing a structural border for a piece of cardboard or other sheet good to be displayed behind the window 260.

A plurality of holes 270 are formed through the sheet 261 about the perimeter thereof. The holes 270 correspond in number and arrangement with the posts 250 on the frame 241. Each of the holes 270 is surrounded by a cylindrical depression 271. The window 260 is secured to the frame 241 by inserting each post 250 through a respective hole 270 and then subjecting the posts 250 to heat (or some other form of melting energy) until the tips of the posts 250 melt into tabs or buttons within the depressions 271. Once so secured, the window 260 may be described as a part of the front panel 240, and/or the front panel 240 may be described as having a window 260.

Figure 6:
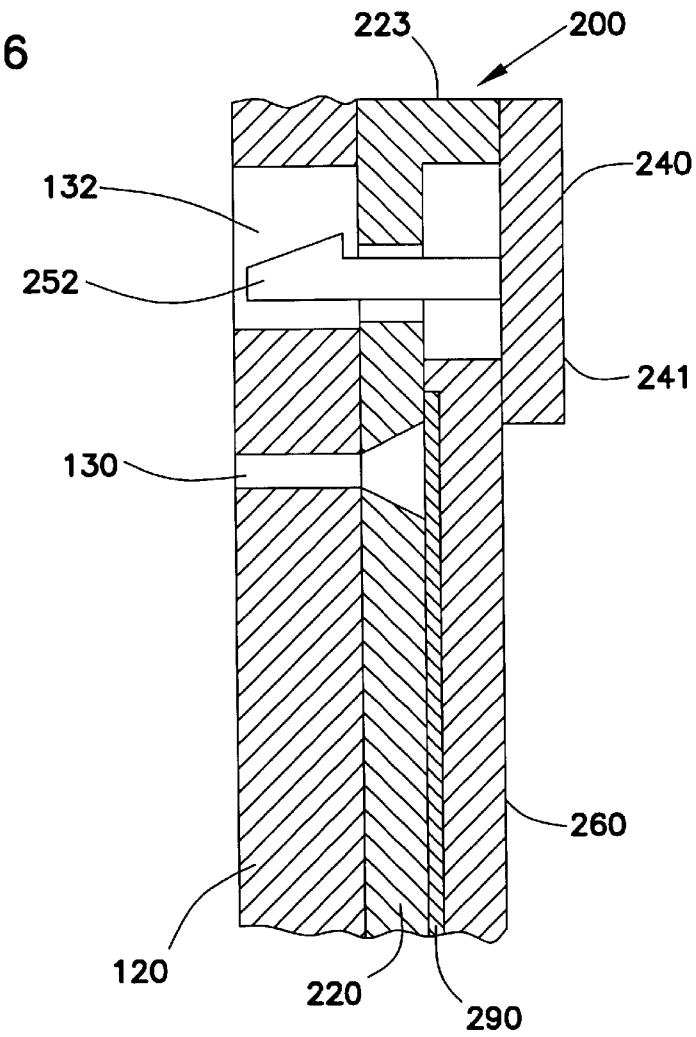
FIG. 6 is a partial sectioned side view of a door on the vending machine of FIG. 1, the frame of FIG. 3, and the frame window of FIG. 4, all shown together in an assembled state.

As shown in FIG. 6, the display 200 may be secured to the vending machine 100 by inserting fasteners through the holes 230 in the rear panel 220 and into holes 130 in door 120, and by forming an opening 132 in the door 120 to accommodate the prongs 252. Alternatively, the rear panel 220 could be secured to the vending machine door panel 120 by means other than such as fasteners by adhesive or by double-sided tape (not shown). Once the rear panel 220 is secured in place on the door 120, a sheet good 290, such as a cardboard sign, may be disposed between the window 260 and the rear panel 220. The front panel 240 may then be pushed toward the rear panel 220 until the prongs 252 latch into place. The prongs 252 may then be unlatched only by gaining access to the inside of the door 120 and the heads 255 on the prongs 252.

The present invention has been described with reference to a preferred embodiment and a specific application. However, those skilled in the art will recognize additional embodiments and/or applications which nonetheless fall within the scope of the present invention. For example, alternative connectors, such as bolt and lock nut combinations or a cotter pin arrangement, could be used in lieu of the prongs 252. Further, the display panel and rear accessible connector means structure is not limited for use with vending machine door panels, but could be used with any type of panel wherein a rear-activation arrangement is desirable.

Figure 7:
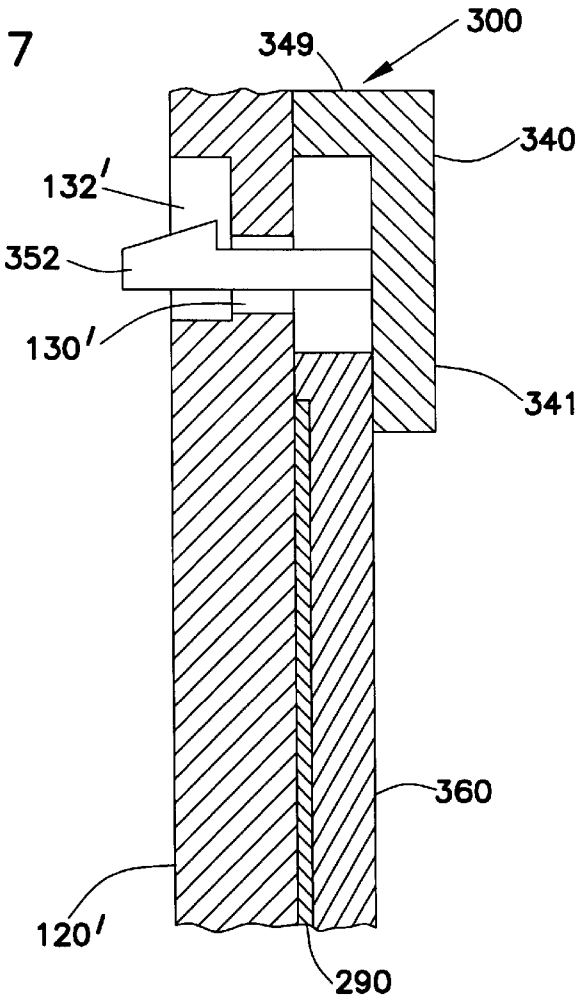
FIG. 7 is a partial sectioned side view of an alternative embodiment vending machine door and externally mounted sign.

One alternative embodiment of the present invention is designated as 300 in FIG. 7. The alternative embodiment display 300 includes a front panel 340 and a window 360, each of which is similar in many respects to its respective counterpart on the preferred embodiment 100. Since there is no rear panel on the alternative embodiment 300, the front panel 340 includes a ridge or embossment 349 extending entirely about its perimeter. Also, the prongs 352 function to secure both the front panel 340 and the entire display 300 relative to the vending machine door 120'. Thus, additional prongs 352 (not shown) are disposed at the opposite end of the front panel 340 in lieu of the hinge 239 on the preferred embodiment 100.

Relatively smaller holes 130' are formed in the door 120' to receive the heads of the prongs 352. Relatively larger openings 132' are formed in the door 120' to accommodate the heads of the prongs 352. The openings 132' also provide access sufficient to facilitate unlatching of the prongs 352 from the inside of the door 120'.

The principles of the present invention could also be applied to items other than vending machines. In this regard, the present invention may be seen to provide a display fastening system suitable for use relative to all sorts of enclosures and/or lockable doors or panels. Accordingly, the scope of protection to be afforded the present invention is to be limited only to the extent of the claims which follow.

What is claimed:

1. A vending machine, comprising:

a base;

a door movable relative to the base between an open position and a closed position, wherein the door has an inside which is accessible when the door occupies the open position but inaccessible when the door occupies the closed position, and the door has an outside surface which is visible from a position external to the vending machine when the door occupies the closed position;

at least one hinge interconnecting said door to said base, wherein said door is pivotally moveable about said hinge, between said open and said closed positions;

a display mounted on the outside surface of the door, said display comprising a latch wherein said latch is biased into engagement with said door and extends from said outside of the door toward said inside of the door and is releasable only upon access to said inside of the door; and a lock interconnecting the door and the base to limit access to said inside of the door.

2. The vending machine of claim 1, wherein the latch is resiliently biased.

3. The vending machine of claim 1, wherein the display includes a front panel and a rear panel, and wherein said latch is connected to the front panel.

4. The vending machine of claim 3, wherein fasteners extend through the rear panel and into the door.

5. The vending machine of claim 3, wherein when the latch is engaged, front panel is movable relative to the rear panel only upon access to the inside of the door.

6. The vending machine of claim 5, wherein the display further includes a sheet disposed between the front panel and the rear panel.

7. The vending machine of claim 6, wherein the display front panel further includes a window allowing viewing of said sheet from external of said door when the door is in said closed position.

8. The vending machine of claim 7, wherein fasteners extend through the rear panel and into the door.

9. The vending machine of claim 1, wherein the display includes a front panel, and a latch interconnecting the front panel and the door.

10. The vending machine of claim 9, wherein the latch and the front panel are integrally molded to one another and made of a resilient material.

11. The vending machine of claim 9, wherein the front panel further includes a window, and wherein the display further includes a sheet disposed between the window and the door.

12. The vending machine of claim 9, wherein the display further includes a rear panel, wherein the rear panel is rigidly secured to the door, and wherein the front panel is releasably latched to the rear panel.

13. A vending machine, comprising:

a chassis having a base and a door cooperatively defining an enclosure having an outer surface facing external of the vending machine, wherein said chassis defines an opening extending through the outer surface and into said enclosure;

a rear panel configured to mount directly on the outer surface, wherein the rear panel has a first side facing toward and engaging the outer surface and a second side facing away from the outer surface and externally from the enclosure;

fasteners securing the rear panel directly to the outer surface, such that said opening provides selective access from said enclosure and through said opening to said first side of the rear panel;

a front panel overlying at least a portion of said second side of the rear panel and said fasteners, said front panel defining a window;

a sheet disposed between the window and the rear panel; and a releasable fastener, connected to at least one of said front panel or said rear panel, releasably securing the front panel for movement relative to the rear panel, wherein the releasable fastener may be released only by gaining access to the first side of the rear panel through said opening in said outer surface.

14. The vending machine of claim 13, wherein the rear panel is mounted on the door, and wherein said opening extends through said door.

15. The vending machine of claim 13, wherein the releasable fastener includes a latch interconnecting the front panel and the rear panel.

16. A method of securing a display to a vending machine, comprising the steps of:

(a) providing a door on the vending machine, said door having outside and inside surfaces;

(b) forming a hole through the door, said hole being substantially smaller than said display;

(c) positioning the display on the outside surface of the door and overlying said hole;

(d) opening the display;

(e) disposing a sheet within the display;

(f) providing a catch on the display;

(g) closing the display in such a manner that the catch is accessible only through said hole and from the inside surface of the vending machine; and (h) locking the door to discourage unauthorized access to the catch.

17. The method of claim 16, further comprising the steps of providing a rear panel on the display, and rigidly securing the rear panel to the door.

18. The method of claim 17, further comprising the steps of providing a front panel on the display, and interconnecting a hinge between the front panel and the rear panel.

* * * * *

UNITED STATES PATENT AND TRADEMARK OFFICE

CERTIFICATE OF CORRECTION

PATENT NO. : 6,128,842
DATED : October 10, 2000
INVENTOR(S) : Lotspeich et al.

It is certified that error appears in the above-identified patent and that said Letters Patent is hereby corrected as shown below:

Column 5,
Line 51, "latch is engaged, front" should read -- latch is engaged, the front --

Signed and Sealed this

Thirtieth Day of April, 2002

*Attest:*

*Attesting Officer*

JAMES E. ROGAN
*Director of the United States Patent and Trademark Office*